US005763154A

United States Patent [19]

Gysling et al.

[11] Patent Number: 5,763,154

[45] Date of Patent: Jun. 9, 1998

[54] PALLADIUM CHEMICAL SENSITIZERS FOR SILVER HALIDES

[75] Inventors: Henry James Gysling; Kenneth James Lushington, both of Rochester, N.Y.

[73] Assignee: Eastman Kodak Company, Rochester, N.Y.

[21] Appl. No.: 689,325

[22] Filed: Aug. 7, 1996

[51] Int. Cl.[6] ..... G03C 1/09

[52] U.S. Cl. ..... 430/603; 430/604

[58] Field of Search ..... 430/603, 604

[56] References Cited

U.S. PATENT DOCUMENTS

| | | | |
|---|---|---|---|
| 2,448,060 | 8/1948 | Smith et al. . | |
| 2,540,086 | 2/1951 | Baldsiefen et al. . | |
| 2,598,079 | 5/1952 | Stauffer et al. . | |
| 3,297,446 | 1/1967 | Dunn . | |
| 3,297,447 | 1/1967 | McVeigh . | |
| 4,092,171 | 5/1978 | Bigelow . | |
| 4,258,128 | 3/1981 | Gysling | 430/413 |
| 5,112,733 | 5/1992 | Ihama . | |
| 5,248,588 | 9/1993 | Nagaoka . | |

FOREIGN PATENT DOCUMENTS

| | | |
|---|---|---|
| 0 368 304 | 11/1989 | European Pat. Off. . |
| 0 541 104 | 11/1992 | European Pat. Off. . |

*Primary Examiner*—Thorl Chea
*Attorney, Agent, or Firm*—Paul A. Leipold

[57] ABSTRACT

The invention is generally accomplished providing a silver halide emulsion comprising silver halide grains and a palladium compound represented by Formula I:

$$PdX_2(TeR_2)_2$$

wherein

X is Cl, Br, I, NCO, NCS, NCSe, $N_3$, or $O_2CR'$

R, R' are alkyl or aryl.

13 Claims, No Drawings

PALLADIUM CHEMICAL SENSITIZERS FOR SILVER HALIDES

FIELD OF THE INVENTION

The invention relates to compounds utilized in chemical sensitization of silver halide compounds. It particularly relates to palladium compounds utilized in chemical sensitization of silver halides utilized in color negative film.

BACKGROUND OF THE INVENTION

Photographic silver halide materials are often chemically sensitized with one or more compounds containing labile atoms of gold, sulfur or selenium and the like to provide increased sensitivity to light and other sensitometric properties. Examples of typical chemically sensitized photographic silver halide emulsions are described in, for example, *Research Disclosure,* Item No. 308119, December 1989, Section III, and the references listed therein (Research Disclosure is published by Kenneth Mason Publications Ltd., Dudley Annex, 12a North Street, Emsworth, Hampshire PO 10 7DQ, England.) In *Research Disclosure,* Item No. 36544, September 1994, Section IV, page 510, there are a variety of chemical sensitizers disclosed.

The use of palladium compounds as chemical sensitizers has been described in prior art patents. A 1978 patent (J. H. Bigelow, U.S. Pat. No. 4,092,171 (1978; E. I. Du Pont): Organophosphine Chelates of Platinum and Palladium as Sensitizers) describes the use of palladium(II) chloride complexes with triorganophosphine ligands, e.g., $\{PdCl_2(PPh_3)_2\}$ as sensitizers for silver halide emulsions.

A 1992 patent (M. Ihama, U.S. Pat. No. 5,112,733 (1992; Fuji): Silver Halide Photographic Emulsion) claims a variety of Pd(II) compounds (and the Pd(0) complex, $\{Pd(PPh_3)_4\}$) as chemical sensitizers. The Pd(II) complexes $\{PdCl_2(PPh_3)_2\}$ and $\{Pd(O_2CCH_3)_2(PPh_3)_2\}$ are cited in a claim. Sensitizations described in patent examples used (KSCN/N, N-dimethylselenourea/$(NH_4)_2\{PdCl_4\}$), (KSCN/N,N-dimethylselenourea/$KAuCl_4/K_2\{PdCl_4\}$), (KSCN/$(NH_4)_2\{PdCl_4\}/Na_2S_2O_3$) and (N,N-dimethylselenourea/$HAuCl_4$/KSCN/$(NH_4)_2\{PdCl_4\}$.

Several early Kodak patents described the use of Pd(II) and Pd(IV) halo complexes (i.e., $\{PdX_4\}^{2-}$ and $\{PdX_6\}^{2-}$ (X=Cl, Br, I) as chemical sensitizers for silver halide emulsions:

W. F. Smith and A. P. H. Trivelli, U.S. Pat. No. 2,448,060 (1948; Eastman Kodak Co.): Photographic Emulsions Sensitized with Salts of Metals of Group VIII of the Periodic Arrangement of the Elements.

R. E. Stauffer and W. F. Smith, U.S. Pat. No. 2,598,079 (1952; Eastman Kodak Co.): High-Speed Photographic Silver Halide Emulsions Supersensitized With Palladium Salts.

J. S. Dunn, U.S. Pat. No. 3,297,446 (1967; Eastman Kodak Co.): Synergistic Sensitization of Photographic Systems with Labile Selenium and a Noble Metal.

P. A. McVeigh, U.S. Pat. 3,297,447 (1967; Eastman Kodak Co.): Stabilization of Synergistically Sensitized Photographic Systems.

A 1951 Du Pont patent (W. D. Baldsiefen, L. J. Conrad, and R. N. Linkhart, U.S. Pat. No. 2,540,086 (1951; E. I. Du Pont): Silver Halide Emulsions) discloses the use of a mixture of water soluble salts of gold, palladium, (e.g., $PdCl_2.2H_2O$) and mercury as a sensitizer for a silver bromoiodide emulsion.

A 1992 patent (M. Szucs, J. Csaplaros, J. Becso, L. Fenichel, P. Bako and L. Toke, U.S. Pat. No. 5,169,751 (1992; Forte Photochemical Industry, Hungary): Process for the Chemical Sensitization of Silver Halide Photographic Emulsions) discloses the use of Pd(II) (or Au(III)) complexes with crown ether type macrocycles as chemical sensitizers used in combination with sulfur and $Au_2S$ or $Au_2S_3$ sensitization.

A recent patent (M. Ihama, Y. Kume, and H. Takehara, European Patent 368,304-B (1994; Fuji Photo Film Co., Ltd.): Method of Manufacturing Silver Halide Photographic Emulsion) discloses the use of $(NH_4)_2\{PdCl_4\}$ as a chemical sensitizer.

A 1993 Fuji patent (K. Nagaoka, U.S. Pat. No. 5,248,588 (1993; Fuji): Silver Halide Photographic Material) discloses the use of palladium complexes as sensitizers for negative-working internal latent image-forming silver halide grains which are chemically sensitized to a depth of less than 0.02μ from the grain surface. The examples use $K_2\{PdCl_6\}$ and $Na_2\{PdCl_4\}$ .

A Konica patent (T. Nakayama, European Patent Application 0 541 104 A (1993; Konica Corp.): Silver Halide Photographic Emulsion and Light-Sensitive Silver Halide Photographic Material Making Use of Same) has described the use of noble metal complexes, including $(NH_4)_2\{PdCl_4\}$, to release gold from gelatin binding and promote the adsorption of gold ions to silver halide grains, thereby improving the efficiency of the gold sensitization (the palladium complex is added in an amount ranging from 10 to 100 times the molar amount of the gold sensitizer).

East German workers have reported Pd(II) complexes with bi-, tri- and tetradentate amine type ligands as chemical sensitizers (e.g., $\{Pd(dien)SCN\}BPh_4$, $\{Pd(dien)_2\}(BPh_4)_2$, and $\{Pd(trien)_2\}(BPh_4)_2$: dien=diethylenetriamine; trien=triethylenetetraamine) (J. Hartung, E. Berndt, L. Beyer, and E. Hoyer, E. German Patent 231,431 (1985; VEB Filmfabrik Wolfen): New Pd and Pt Complex Photographic Sensitizer Comprising Neutral Lewis Base Metal Tetraarylborate Complex Compound).

Another German patent discloses the use of Au-Pd sensitization using $M\{Au(SCN)_2\}$ and $M_2\{Pd(SCN)_4\}$ (M=alkali metal cation, $NH_4^+$) (S. Gahler, T. Leichsenring, H. Pietsch, K. Schuetze, J. Siegel, M. Sydow, and H. Ullmann, DD Patent 298,321 (1992; Filmfabrik Wolfen AG): Gold Sensitization of Emulsion with High Silver-Gelatin Ratio Using Gold and Palladium as Complex Thiocyanate at Relatively High Gelatin Concentration).

Sensitization of X-ray film using $K_2\{Pd(SCN)_4\}$ or $K_2\{PdCl_4\}$ has been claimed in a 1990 patent (D. Ballschuh, R. Boje, E. Kiessling, G. Kordulla, A. Neumann, R. Ohme, H. Seibt, and W. Wild, D.D. Patent 282,998 (1990; (Foto) VEB Fotochem Werke Berlin).

A 1987 East German patent discloses sensitization of silver halide emulsions by a 1:2 Pd (or Ni or Pt) complex of an Ag coordination compound of a tri-, di-, or monohydroxy-ethylene mono, di, or trithiol or ethylene tetrathiol (M. Freise, E. Hoyer, and P. Stauch, D.D. Patent 246,852 (1987; Karl Marx Univ., Leipzig).

Emulsion sensitization by Pd(II) (or Pt(II)) complexes of alkyl alpha-cyano-beta-alkyl- or aryl-beta-aminothioacrylate esters (E. Berndt, L. Beyer, R. Boran, J. Hartung, E. Hoyer, J. Kreutzmann, D.D. Patent 231,430 (1985; VEB Filmfabrik Wolfen) and $M_2\{PdX_4\}$ (M=Na, K, $NH_4$; X=Cl, Br, SCN, $NO_2$) ((E. Berndt, S. Gahler, G. Roewer, and A. Winzer, D.D. Patent 215,410 (1984; VEB Filmfabrik Wolfen): Chemical Sensitization and Clarification of Photographic Silver Halide Emulsions) have also been described.

Russian patents have reported the use of complexes of the type $H_xMLCl_z$ (M=Pd, Pt; x=2, 3; z=1,2; L=anion of ethylenetriamine-N,N,N',N'-pentaacetic acid, or ethylenediamine-N,N,N',N'-tetraacetic acid or cyclohexanediamine-N,N,N',N'-tetraacetic acid) (L. R. Bratkova, A. I. Kharitonova, and A. F. Peshkin, S.U. Patent 1,659,968 (1991; Chem. Photo. Ind. Res. Des. Inst., Univ. of Moscow): Hypersensitization of Silver Halide Photographic Materials by Treatment With Solution Containing Specified Complex Compound of Platinum or Palladium, Water Soluble Halide and Water) and $M_xPd_yLA_z$ (M=H, Na; A=$Cl^-$, $SO_4^{2-}$ or phenanthroline; L=ethylenediamine-N,N'-diacetic acid, ethylenediamine-N,N,N',N'-tetraacetic acid, diethylenetriamine-N,N,N',N'-pentaacetic acid or triethylenetetraamine-hexaacetic acid) (L. R. Bratkova, A. I. Kharitonova, and A. F. Peshkin, S.U. Patent 1,644,070 (1991; Moscow Univ.) as chemical sensitizers.

Palladium (II) coordination complexes of the general formula:

$$PdX_2\{Te((CH_2)_nSiRR'R'')_2\}_2$$

X=halide or pseudohalide
n=1–10
R, R', R"=alkyl, aryl
have been claimed in three patents as compositions of matter and as photosensitive elements:

(a) H. J. Gysling, U.S. Pat. No. 4,394,318 (1983): Tellurium(II) Compounds and Complexes Having Organic Moieties Containing Silicon.

(b) H. J. Gysling, U.S. Pat. No. 4,287,354 (1981): Tellurium(II) Compounds and Complexes Having Organic Moieties Containing Silicon.

(c) H. J. Gysling, U.S. Pat. No. 4,258,128 (1981): Tellurium(II) Compounds and Complexes Having Organic Moieties Containing Silicon Containing Compositions, Articles and Photoimaging Process.

The art believed of most interest discussed above is U.S. Pat. No. 4,092,171; U.S. Pat. No. 2,448,060; U.S. Pat. No. 2,598,079; U.S. Pat. No. 3,297,446; U.S. Pat. No. 3,297,447; EP 0 368 304; U.S. Pat. No. 5,248,588; and EP 0 541 104.

PROBLEM TO BE SOLVED BY THE INVENTION

However, while the prior palladium chemical sensitizers have been successful to a limited degree, there is a continuing need for chemical sensitizers that are more efficient and stable in providing improved sensitization to silver halide emulsions. There is also a continuing need for low cost sensitizers.

SUMMARY OF THE INVENTION

It is an object of the invention to provide improved chemical sensitizers for silver halide emulsions.

It is a further object of the invention to provide silver halide emulsions of greater sensitivity.

These and other objects of the invention generally are accomplished by a silver halide emulsion comprising silver halide grains and a palladium compound represented by Formula I:

$$PdX_2(TeR_2)_2 \qquad \text{I}$$

wherein

X is Cl, Br, I, NCO, NCS, NCSe, $N_3$, or $O_2CR'$

R is alkyl or aryl

R' is alkyl or aryl.

ADVANTAGEOUS EFFECTS OF THE INVENTION

An advantage of the invention is highly sensitized silver halide emulsions. Another advantage of the invention is the providing of stable palladium sensitizers.

DETAILED DESCRIPTION OF THE INVENTION

The invention palladium sensitizers have not been previously utilized as chemical sensitizers. The palladium compounds of the invention have numerous advantages over prior materials. The Pd(II) coordination complexes of this invention give improved sensitization compared to prior art palladium sensitizers. The Pd(II) coordination complexes of this invention exhibit enhanced stability under ambient keeping conditions compared to prior art palladium sensitizers. The Pd(II) coordination complexes of this invention can be prepared in high yields by convenient synthetic procedures.

The chemical sensitizers of this invention provide new silver halide chemical sensitizers which incorporate a noble metal and 1 or more chalcogen atoms in one molecular species. Such compositions can be considered as "single source sensitizers" analogous to "single source precursors" recently described as molecular reagents for the MOCVD fabrication of thin films of electronic materials such as 3–5 semiconductors (e.g., see A. H. Cowley and R. J. Jones, Polyhedron, 13, 1149 (1994)).

The new chemical sensitizers of this invention can be purified by recrystallization to give crystalline solids of high purity which can be introduced into a silver halide emulsion in the finishing step as a methanol solution.

The palladium compounds are generally formed by the techniques disclosed in H. J. Gysling, Coord. Chem. Rev., 42, 163–175 (1982) and references therein.

The palladium complexes of this invention provide rapid chemical sensitization as a result of their lack of interaction with gelatin, a common problem for prior art palladium compounds.

Any tellurium compound as set forth in Formula I is a suitable sensitizer. Preferred sensitizers have been found to be $Pd(SCN)_2(Te(CH_2SiMe_3)_2)_2$, $(PdCl_2(Te(CH_2SiMe_3)_2)_2$, $Pd(SCN)_2(Te(CH_2CH_2CH_2SiMe_3)_2)_2$, and $PdBr_2(Te(CH_2CH_2Ph)_2)_2$. The most preferred compounds are the following palladium compounds that provide a significant increase in sensitization, are low in cost, and stable: $(PdCl_2(Te(CH_2SiMe_3)_2)_2$ and $Pd(SCN)_2(Te(CH_2CH_2CH_2SiMe_3)_2)_2$.

Typical compounds of the Formula I suitable for the invention are listed in Table 1 below.

TABLE 1

Examples of Pd(II) Coordination Complexes Typical of the General Formula $\{PdX_2(TeR_2)_2\}$ 1) $PdCl_2\{Te(CH_2CH_2Ph)_2\}_2$
2) $PdBr_2\{Te(CH_2CH_2Ph)_2\}_2$
3) $PdI_2\{Te(CH_2CH_2Ph)_2)_2\}_2$
4) $Pd(SCN)_2\{Te(CH_2CH_2Ph)_2\}_2$
5) $Pd(SeCN)_2\{Te(CH_2CH_2Ph)_2\}_2$
6) $PdCl_2\{Te(CH_2Ph)_2\}_2$
7) $PdBr_2\{Te(CH_2Ph)_2\}_2$ 8) $PdI_2\{Te(CH_2Ph)_2\}_2$
9) $Pd(SCN)_2\{Te(CH_2Ph)_2\}_2$
10) $Pd(SeCN)_2\{Te(CH_2Ph)_2\}_2$
11) $PdCl_2\{Te(CH_2SiMe_3)_2\}_2$
12) $PdBr_2\{Te(CH_2SiMe_3)_2\}_2$
13) $PdI_2\{Te(CH_2SiMe_3)_2\}_2$
14) $Pd(SCN)_2\{Te(CH_2SiMe_3)_2\}_2$
15) $Pd(SeCN)_2\{Te(CH_2SiMe_3)_2\}_2$
16) $PdCl_2\{Te(t\text{-}Bu)_2\}_2$
17) $PdBr_2\{Te(t\text{-}Bu)_2\}_2$
18) $PdI_2\{Te(t\text{-}Bu)_2\}_2$
19) $Pd(SCN)_2\{Te(t\text{-}Bu)_2\}_2$
20) $Pd(SeCN)_2\{Te(t\text{-}Bu)_2\}_2$
21) $PdCl_2\{Te(CH_2CH_2CH_2SiMe_3)_2\}_2$
22) $PdBr_2\{Te(CH_2CH_2CH_2SiMe_3)_2\}_2$
23) $PdI_2\{Te(CH_2CH_2CH_2SiMe_3)_2\}_2$
24) $Pd(SCN)_2\{Te(CH_2CH_2CH_2SiMe_3)_2\}_2$
25) $Pd(SeCN)_2\{Te(CH_2CH_2CH_2SiMe_3)_2\}_2$
26) $Pd(NCO)_2\{Te(CH_2CH_2CH_2SiMe_3)_2\}_2$
27) $Pd(N_3)_2\{Te(CH_2CH_2CH_2SiMe_3)_2\}_2$
28) $PdCl_2\{Te(CH_2CH_2C_6H_{11})_2\}_2$
29) $PdBr_2\{Te(CH_2CH_2C_6H_{11})_2\}_2$
30) $PdI_2\{Te(CH_2CH_2C_6H_{11})_2\}_2$
31) $Pd(SCN)_2\{Te(CH_2CH_2C_6H_{11})_2\}_2$
32) $Pd(SeCN)_2\{Te(CH_2CH_2C_6H_{11})_2\}_2$ The palladium complexes of the invention may be utilized in any suitable amount. Typically the palladium compounds would be utilized in an amount between about 0.1 and 100 μmol/mol Ag. Preferably they would be utilized in an amount between about 5 and 50 μmol/mol Ag.

The palladium complexes of the invention may be added to a silver halide emulsion at various stages during emulsion preparation and finishing. The palladium compounds may be added during emulsion formation, or they may be added after emulsion formation and after washing of the emulsion. They may be added prior to a heat cycle for chemical sensitization or they may be added during the heat cycle after the emulsion has been brought to an increased temperature. It is preferred that they be added either prior to or during the sensitization cycle. The heat cycle is preferably carried out at a temperature of between about 30° and 90° C. with a preferred temperature of addition being between 40° and 70° C. The addition may take place prior to heating or after heating has taken place. The palladium sensitizing compounds may be added singly or in combination with other sensitizing agents. They also may be added to a silver halide emulsion along with silver ion ligands and silver halide growth modifiers or stabilizers and the antifogging agents. Further, the palladium complexes of the invention may be added with other chemical sensitizing agents such as sulfur, selenium, or noble metal compounds such as those of gold, platinum, rhodium, or iridium compounds or with dopants such as iron, iridium, rhodium, ruthenium, or osmium complexes. The palladium compounds may be added during formation of silver halide grains, during the physical or chemical ripening stage, or in a separate step immediately prior to coating to form a photographic element.

This invention provides a process for chemical sensitizing a silver halide emulsion formed according to any of the processes generally well known in the art. A double jet-type process is preferred. The silver halide grains can comprise mixed or single halide components and especially include chloride, bromide, iodide, iodochloride, iodobromide or chlorobromide grains. They can also be different morphologies such as cubic, tabular core shell or tetradecahedral.

The double-jet process comprises adding an aqueous silver nitrate solution and an aqueous solution of one or more halides, for example, an alkali metal halide such as potassium bromide, potassium chloride, potassium iodide or mixtures thereof, simultaneously to a stirred solution of a silver halide protective colloid through two separate jets.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose and cellulose sulfate, sugar derivatives such as sodium alginate, starch derivatives and various synthetic peptizers such as hydrophilic homopolymers or copolymers such as polyvinyl alcohol, poly-N-vinylpyrrolidone, polyacrylic acid, polymethacrylic acid, polyacrylamide, polyvinylimidazole and polyvinyl pyrazole can be used.

Acid-processed gelatin can be used, as well as lime-processed gelatin. Further, gelatin hydrolyzates and enzyme-hydrolyzed products of gelatin are also usable.

Surface-active agents may be incorporated in a photographic emulsion layer or in another hydrophilic colloid layer as a coating aid to prevent buildup of static charge, to improve lubrication properties, to improve emulsion dispersion, to prevent adhesion and to improve other properties.

A photosensitive material of the present invention may contain antifogging agents or emulsion-stabilizing agents such as, for example, azaindenes, disulfides, thionamides, azoles and the like.

The photographic silver halide emulsions as described can be used in photographic silver halide elements in any of the ways and for purposes known in the photographic art.

The photographic silver halide emulsions can be used and incorporated in photographic elements that are black and white, single color elements or multicolor elements. Multicolor elements contain dye image-forming units sensitive to each of the three primary regions of the visible spectrum. Each unit can be comprised of a single emulsion layer or of multiple emulsion layers sensitive to given regions of the spectrum. The layers of the element can be arranged in various orders as known in the art.

In the following discussion of suitable materials for use in emulsions and elements of the invention, reference will be made to *Research Disclosure*, Number 36544 of September 1994. *Research Disclosure* is published by Kenneth Masons Publications Ltd., Dudley House, 12A North Street, Emsworth, Hampshire PO 10 7DQ, England. This publication will be identified hereafter by the term "Research Disclosure".

The silver halide emulsions of the invention can be used in elements that can be either negative-working or positive-working. The emulsions in which the described new chemical sensitizers can be used are described in, for example, *Research Disclosure* Sections I, II and III and the publications and patents cited therein. Useful vehicles for the emulsion layers and other layers of elements of the invention are described in *Research Disclosure* Section IX and the publications cited therein.

The described photographic emulsions can be used in color photographic elements with couplers as described in *Research Disclosure* Section X and the publications cited therein. The couplers can be incorporated in the elements and emulsions as described in *Research Disclosure* Section XI and ways known in the art.

The photographic elements and emulsions as described can contain addenda known to be useful in photographic elements and emulsions in the photographic art. The photographic elements and emulsions as described can contain, for example, brighteners (see *Research Disclosure* Section VI); antifoggants and stabilizers (see *Research Disclosure* Section VII); antistain agents and image dye stabilizers (see *Research Disclosure* Section X); light absorbing and scattering materials (see *Research Disclosure* Section II); hardeners (see *Research Disclosure* Section IX); coating aids (see *Research Disclosure* Section IX); plasticizers and lubricants (see *Research Disclosure* Section IX); antistatic agents (see *Research Disclosure* Section IX); matting agents (see *Research Disclosure* Section IX); and development modifiers (see *Research Disclosure* Section XVIII).

The photographic silver halide materials and elements as described can be coated on a variety of supports as described in *Research Disclosure* Section XV and the publications cited therein.

The photographic silver halide materials and elements as described can include coarse, regular and fine grain silver halide crystals or mixtures thereof and can be comprised of any photographic silver halides known in the photographic art.

The photographic silver halide materials as described can be spectrally sensitized by means and dyes known in the photographic art, such as by means of spectral sensitizing dyes as described in, for example, *Research Disclosure* Section V and the publications cited therein. Combinations of spectral sensitizing dyes are especially useful.

Photographic materials and elements as described can be exposed to actinic radiation, typically in the visible region of the spectrum, to form a latent image as described in *Research Disclosure* Section XVI and then processed to form a visible image as described in, for example, *Research Disclosure* Section XVIII using developing agents and other processing agents known in the photographic art. Processing to form a visible image, typically a dye image, includes the step of contacting the element with a developing agent, typically a color developing agent, to reduce developable silver halide and oxidize the developing agent. In a color material the oxidized color developing agent in turn reacts with couplers to yield a dye.

The photographic silver halide materials can also be used in physical development systems as described in *Research Disclosure* Section XVII, in image-transfer systems as described in *Research Disclosure* Section X, in dry development systems as described in *Research Disclosure* Section XVII and in printing and lithography materials as described in *Research Disclosure* Section XIX.

The photosensitive materials obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), aminophenols (e.g., N-methyl-p-amino-phenol), 1-phenyl-3-pyrazolidones or ascorbic acids.

As color-developing agent, there can be used primary aromatic amine developing agents such as phenylenediamines (e.g., 4-amino-N,N-diethylaniline, 3-methyl-4-amino-N,N-diethylaniline, 4-amino-3-methyl-N-hydroxyethylaniline, 3-methyl-4-amino-N-ethyl-N-hydroxyethylaniline, 3-methyl-4-amino-N-ethyl-N-methanesulfonamido-ethylaniline and 4-amino-3-methyl-N-ethyl-N-methoxyethylaniline. In addition, the developing agents described in L. F. A. Mason, *Photographic Processing Chemistry* (Focal Press, 1966), pp. 226–229, as well as those described in U.S. Pat. Nos. 2,193,015 and 2,592,364 may be used.

A photographic emulsion useful in the present invention can be applied to many different silver halide photographic light-sensitive materials due to its high photographic sensitivity, contrast, and fog reduction. For example, it can be used in high speed black-and-white negative films, in X-ray films and in multilayer color negative films.

The invention is particularly suitable for use with tabular silver bromoiodide grains which find their preferred use in color negative films. In such films it is particularly important that higher speeds be obtained, as there is a continuing need for higher speed films for color negative photography.

The following examples illustrate the practice of this invention. They are not intended to be exhaustive of all possible variations of the invention. Parts and percentages are by weight unless otherwise indicated.

SYNTHETIC METHODS FOR PREPARATION OF Pd(II) COMPLEXES OF THIS INVENTION

The general synthetic routes which can be used to prepare the complexes of this invention are known in the prior art. The starting dialkyl telluride ligands can be most conveniently prepared by alkylation of $Na_2Te$ with the appropriate alkyl chloride as described in:

(a) H. J. Gysling, U.S. Pat. No. 4,394,318 (1983): Tellurium(II) Compounds and Complexes Having Organic Moieties Containing Silicon (b) H. J. Gysling, U.S. Pat. No. 4,287,354 (1981): Tellurium(II) Compounds and Complexes Having Organic Moieties Containing Silicon (c) H. J. Gysling, H. R. Luss, and D. L. Smith, Inorg. Chem., 18, 2696 (1979): New Dialkyl Tellurides: Synthesis and Ligand Properties of $Te\{(CH_2)_xSiMe_3\}_2$ (n=1,3) and Crystal Structure of trans-$Pd(SCN)_2\{Te(CH_2CH_2CH_2SiMe_3)_2\}_2$ (d) H. J. Gysling, Kodak Laboratory Chemical Bulletin, 53, No. 1, (1982): The Synthesis of Organotellurium Ligands (e) H. J. Gysling, Coord. Chem. Rev., 42, 133–244 (1982): The Ligand Chemistry of Tellurium (Pd(II) Complexes: see pgs. 163–176).

The Pd(II) complexes which are used as starting materials for the syntheses of the complexes of this invention have been also described in the literature.

$K_2\{PdCl_4\}$: Gmelin's Handbuch der Anorganischen Chemie, 64, 83 (1938)

$PdCl_2(NCPh)_2$: M. S. Kharasch, R. C. Seyler and F. R. Mayo, J. Amer. Chem. Soc., 60, 882 (1938)

$PdCl_2(MeCN)_2$: T. Kemmitt, W. Levason, R. D. Oldroyd, and M. Webster, Polyhedron, 11, 2165 (1992)

$K_2Pd(SCN)_4$: N. J. DeStefano and J. L. Burmeister, Syn. Inorg. Met.-Org. Chem., 3, 313 (1973).

Using the diorgantellurides and Pd(II) starting materials described above, the complexes of this invention can be prepared by the following synthetic routes:

$$K_2\{PdCl_4\} + 2\,TeR_2 \xrightarrow{H_2O/MeOH} \{PdCl_2(TeR_2)_2\} + 2\,KCl$$

$$\{PdCl_2(NCPh)_2\} + 2\,TeR_2 \xrightarrow[\text{or toluene}]{CH_2Cl_2} \{PdCl_2(TeR_2)_2\} + 2\,PhCN$$

$$K_2\{Pd(XCN)_4\} + 2\,TeR_2 \xrightarrow{MeOH} \{Pd(XCN)_2(TeR_2)_2\} + 2\,KSCN$$

$$X = S, Se$$

The complexes are generally red, crystalline solids which can be recrystallized from organic solvents and exhibit sufficient solubility in methanol for preparation of doctor solutions in this solvent.

EXAMPLES

Example 1

Synthesis of $PdCl_2\{Te(CH_2SiMe_3)_2\}_2$

To a solution of 1.9 g (4.95 mmoles) $PdCl_2(NCPh)_2$ (prepared as described by M.S. Kharasch et al in J. Am. Chem. Soc., 60, 882 (1938) in 225 ml of benzene were added 3.2 g (10 mmoles) of $Te(CH_2SiMe_3)_2$ (prepared as described in H. J. Gysling et al. Inorg. Chem., 18, 2696 (1979)) dissolved in 25 ml of benzene. This reaction solution was stirred at room temperature for 30 min., concentrated to dryness under vacuum and the residue was recrystallized from 185 ml 4:1 methanol-hexane to give, on cooling to −10° C., a crop of orange needles (1.95 g (50.4%); Calcd. (Found) for $C_{16}H_{44}Cl_2PdSi_4Te_2$ (MW=781.38); C, 24.59 (24.0); H, 5.68, (5.5); Cl, 9.07 (9.3); Pd, 13.62 (13.4)).

Example 2

Synthesis of $Pd(SCN)_2(Te(CH_2SiMe_3)_2\}_2$

To a solution of $K_2\{Pd(SCN)_4\}$ (4.15 g, 10 mmoles) dissolved in 300 ml of methanol 6.04 g (20 mmoles) of $Te(CH_2SiMe_3)_2$ was added. The solution was then stirred for 30 min. at room temperature and concentrated under vacuum to 70 ml to give a crop of red crystals. The red crystals were isolated by filtration, vacuum dried; and then recrystallized from 80 ml of 1:1 hexane-methanol. Cooling the filtered recrystallization solution overnight at −10° C. gave a crop of deep red crystals (5.6 g (68% yield); Calcd. (Found) for $C_{18}H_{44}N_2PdS_2Si_4Te_2$ (MW=826.63); C, 26.15 (26.00); H, 5.37 (5.2); N, 3.39 (3.6); S, 7.76 (7.4); Pd, 12.87 (12.7)).

Example 3

Synthesis of $PdCl_2\{Te(CH_2CH_2Ph)_2\}_2$

Addition of a solution of 2.03 g (6 mmoles) of $Te(CH_2CH_2Ph)_2$ (prepared by the alkylation of $Na_2Te$ with $PhCH_2CH_2Cl$ in aqueous methanol as described in H. J. Gysling, N. Zumbulyadis and J. A. Robertson, J. Organometal. Chem., 209, C41 (1982)) in 15 ml of toluene to a toluene solution (150 ml) of 1.15 g (3 mmoles) $PdCl_2(NCPh)_2$ (prepared as described in M. S. Kharasch, R. C. Seyler, and F. R. Mayo, J. Am. Chem. Soc., 60, 882 (1938)) resulted in the immediate lightening in color of the initial dark red solution. The reaction solution was stirred for 15 min. and concentrated under vacuum to give a red gum which, on trituration with hexane, gave a brown powder (2.2 g; 85.8% yield). Recrystallization of this crude product from 100 ml of 1:1 ethanol-toluene gave a crop of orange-red needles (1.5 g (54.7% yield): Calcd. (Found) for $C_{32}H_{36}Cl_2PdTe_2$ (MW =853.1): C, 45.1 (45.2); 1 H, 4.3 (4.4); Cl, 8.3 (8.0); Pd, 12.5 (12.8)).

Example 4

Synthesis of $Pd(SCN)_2\{Te(CH_2CH_2Ph)_2\}_2$

To a solution of $K_2\{Pd(SCN)_4\}$ (4.15 g, 10 mmoles) dissolved in 300 ml of methanol 6.76 g (20 mmoles) of $Te(CH_2CH_2Ph)_2$ was added. The solution was then stirred for 30 min. at room temperature, and the red precipitated that had deposited was isolated by filtration, washed well with methanol and ether, and vacuum dried (7.63 g; 85% yield). This product was then recrystallized from 225 ml of hot 2:1 i-propanol-ethyl acetate. Cooling the filtered recrystallization solution overnight at −10° C. gave a crop of deep red crystals (6.1 g (67.9% yield); Calcd. (Found) for $C_{34}H_{36}N_2PdS_2Te_2$ (MW=898.40): C, 45.46 (45.5); H, 4.04 (4.2); N, 3.12 (3.1); Pd, 11.84 (11.6); Te, 28.21 (28.3)).

Example 5

Synthesis of $PdCl_2\{Te(CH_2CH_2C_6H_{11})_2\}_2$

Addition of a solution of 1.4 g (4 mmoles) $Te(CH_2CH_2C_6H_{11})_2$ (prepared by the alkylation of $Na_2Te$ with $C_6H_{11}CH_2CH_2Cl$ in aqueous methanol using the general procedure described in H. J. Gysling, H. R. Luss, and D. L. Smith, Inorg. Chem., 18, 2696 (1979)) in 20 ml of methylene chloride to a toluene solution (75 ml) of 0.77 g (2 mmoles) of $PdCl_2(NCPh)_2$ (prepared as described in M. S. Kharasch, R. C. Seyler, and F. R. Mayo, J. Amer. Chem. Soc., 60, 882 (1938)) resulted in the immediate lightening in color of the initial dark red solution. The reaction solution was stirred for 15 min. and concentrated under vacuum to give a red gum which was recrystallized from 100 ml of 1:1 ethanol-methylene chloride to give a crop of orange microcrystals (1.24 g; (70.8% yield): Calcd. (Found) for $C_{32}H_{60}Cl_2PdTe_2$ (MW=877.34): C, 43.81 (43.9); H, 6.89 (6.7); Pd, 12.13 (12.2)).

Example 6

Synthesis of $Pd(SCN)_2\{Te(CH_2CH_2C_6H_{11})_2\}_2$

To a solution of $K_2\{Pd(SCN)_4\}$ (0.83 g, 2 mmoles) dissolved in 150 ml of methanol a solution of 1.4 g (4 mmoles) of $Te(CH_2CH_2C_6H_{11})_2$ in 40 ml of acetone was added. The solution was then stirred for 15 min. at room temperature, and the orange-red precipitate that had deposited was isolated by filtration, washed well with water, and vacuum dried (1.55 g; 83.8% yield). This product was then recrystallized from 75 ml of hot 1:1 ethanol-toluene. Cooling the filtered recrystallization solution overnight at −10° C. gave a crop of orange-red crystals (1.1 g (59.5% yield); Calcd. (Found) for $C_{34}H_{60}N_2PdS_2Te_2$ (MW=922.59): C, 44.26 (43.9); H, 6.56 (6.8); N, 3.04 (2.9); S, 6.95 (6.8); Pd, 11.53 (11.5)).

Example 7

Sensitization of Monodisperse AgBr Emulsion With Palladium Complexes of This Invention A monodisperse AgBr tabular emulsion, prepared as taught in U.S. Pat. No. 5,147,771, with an equivalent circular diameter of 2.4 μm and a thickness of 0.138 μm was treated with the palladium complexes, $\{PdX_2(TeR_2)_2\}$, at a variety of levels and temperatures for 20 minutes as shown in TABLE 5. Once the chemical digestion was complete the example emulsions were cooled and coated on a film support at 1614 mg Ag/m$^2$ and 3230 mg gel/m$^2$. A 1614 mg gel/m$^2$ overcoat was applied over the emulsion containing layers. The coatings were then dried and exposed (0.1 s, 365 nm source) through a graduated density step wedge, processed (6 minutes at 20° C.) in KODAK Rapid X-Ray Developer, washed, and dried. Speeds are expressed as the relative exposure required to increase the measured density to 0.15 above fog. As shown in Table 5, the compounds of the invention provide a significant speed increase.

TABLE 5

Sensitization of the AgBr Tabular Emulsions by $PdX_2(TeR_2)_2$

| R | X | Amount added (μmole) | Temperature | Relative Speed |
|---|---|---|---|---|
| — | | — | — | 100 |
| $Na_2S_2O_3$ | | 25 | 60 | 380 |
| $CH_2SiMe_3$ | Cl | 10 | 40 | 588 |
| $CH_2SiMe_3$ | SCN | 25 | 40 | 363 |
| p-anisyl | Cl | 25 | 40 | 182 |
| p-anisyl | SCN | 25 | 65 | 208 |
| $CH_2CH_2C_6H_{11}$ | SCN | 25 | 40 | 162 |
| $CH_2CH_2Ph$ | SCN | 25 | 65 | 214 |
| $CH_2CH_2Ph$ | Br | 25 | 65 | 363 |
| $CH_2CH_2CH_2SiMe_3$ | SCN | 40 | 65 | 457 |

The invention has been described in detail with particular reference to preferred embodiments thereof, but it will be understood that variations and modifications can be effected within the spirit and scope of the invention.

We claim:

1. A silver halide emulsion comprising silver halide grains and at least one palladium compound represented by Formula I:

$$PdX_2(TeR_2)_2$$

wherein

X is Cl, Br, I, NCO, NCS, NCSe, or $N_3$

R is alkyl or aryl.

2. The emulsion of claim 1 wherein said palladium compound is located on the surface of said grain.

3. The emulsion of claim 1 wherein said palladium compound is present in an amount between 0.1 and 100 μmol/mol Ag.

4. The emulsion of claim 1 wherein said palladium compound is present in an amount between 5 and 50 μmol/mol Ag.

5. The emulsion of claim 1 wherein said palladium compound is selected from the group consisting of $PdCl_2(Te(CH_2SiMe_3)_2)_2$, $Pd(SCN)_2(Te(CH_2SiMe_3)_2)_2$ and $Pd(SCN)_2(Te(CH_2CH_2CH_2SiMe_3)_2)_2$.

6. A method of sensitizing silver halide comprising providing a silver halide grain and bringing said grain into contact with a palladium compound represented by Formula I:

$$PdX_2(TeR_2)_2$$

wherein

X is Cl, Br, I, NCO, NCS, NCSe, $N_3$, or $O_2CR'$

R, R' are alkyl or aryl.

7. The method of claim 6 wherein M is an alkali metal cation selected from the group consisting of $Na^+$, or $K^+$.

8. The method of claim 6 wherein said Formula I compound is present in an amount between 0.1 and 100 μmol/mol Ag.

9. The method of claim 6 wherein said compound of Formula I chemically sensitizes said silver halide grain.

10. The method of claim 6 wherein said Formula I compound is present in an amount between 5 and 50 μmol/mol Ag.

11. The method of claim 6 wherein R is selected from the group consisting of $CH_2SiMe_3$, $CH_2CH_2CH_2SiMe_3$, $CH_2Ph$, $CH_2CH_2Ph$, $CH_2CH_2$-cyclo-$C_6H_{11}$.

12. The method of claim 6 wherein X is selected from the group consisting of Cl, Br, SCN, $N_3$, SeCN.

13. The method of claim 6 wherein said palladium compound comprises $PdCl_2(Te(CH_2SiMe_3)_2)_2$, $Pd(SCN)_2(Te(CH_2SiMe_3)_2)_2$ and $Pd(SCN)_2(Te(CH_2CH_2CH_2SiMe_3)_2)_2$.

* * * * *